US005740571A

United States Patent [19]

Tyra

[11] Patent Number: 5,740,571

[45] Date of Patent: Apr. 21, 1998

[54] FOOT SUPPORT APPARATUS

[75] Inventor: Dorsey Raymond Tyra, Central Islip, N.Y.

[73] Assignees: Fern Tyra, Central Islip, N.Y.; Gary Tyra, Phoenix, Ariz.

[21] Appl. No.: 619,195

[22] Filed: Mar. 21, 1996

[51] Int. Cl.[6] ..... A47C 20/02

[52] U.S. Cl. ..... 5/624; 5/662; 5/648

[58] Field of Search ..... 5/624, 648, 650, 5/662; 482/904, 130

[56] References Cited

U.S. PATENT DOCUMENTS

| | | | |
|---|---|---|---|
| 1,067,733 | 7/1913 | Hassel | 5/651 |
| 1,132,983 | 3/1915 | Shuey . | |
| 1,136,327 | 4/1915 | French . | |
| 1,349,941 | 8/1920 | Broome . | |
| 1,363,023 | 12/1920 | Taylor . | |
| 1,539,082 | 5/1925 | Fyler | 5/651 |
| 3,092,394 | 6/1963 | Burke . | |
| 3,195,151 | 7/1965 | Boyer | 5/651 X |
| 3,361,437 | 1/1968 | Loftis . | |
| 3,625,524 | 12/1971 | Minton | 5/651 |
| 3,866,251 | 2/1975 | Pounds | 5/651 |
| 4,081,870 | 4/1978 | Iannucci . | |
| 4,765,005 | 8/1988 | Hippel | 5/662 X |
| 5,109,872 | 5/1992 | Conn . | |
| 5,175,899 | 1/1993 | Lou | 5/648 X |

*Primary Examiner*—Michael F. Trettel

*Attorney, Agent, or Firm*—Parsons & Goltry; Robert A. Parsons; Michael W. Goltry

[57] ABSTRACT

A bed having a support apparatus for supporting the feet of an individual residing in the bed having a frame and a mattress carried thereon, the support apparatus including a padded foot support member coupled to the frame above the mattress proximate the feet of an individual residing in the bed, the support apparatus operative for allowing the individual to bear his or her feet against the padded foot support member to aid the patient in repositioning his or her body, of for allowing the patient to exercise his or her feet for inhibiting the shortening of the Achilles tendon as a result of prolonged confinement to the bed, and for further inhibiting physiologically adverse effects resulting from such prolonged confinement.

23 Claims, 1 Drawing Sheet

FOOT SUPPORT APPARATUS

BACKGROUND OF THE INVENTION

1. Field of the Invention

This invention relates to support devices.

More particularly, this invention relates to body support devices.

In a further and more specific aspect, the instant invention relates to a support device for use in combination with a bed.

2. Prior Art

During the course of some people's lives, certain misfortunes, such as accidents and illnesses, result in prolonged confinement to a bed for recuperation. Prolonged confinement to a bed, while necessary for proper and adequate recuperation of various injuries and illnesses, can cause physical discomfort and even physical harm.

For example, prolonged confinement to a bed can result in bedsores and the shortening of the Achilles tendons. A bedsore is an ulceration of tissue deprived of blood flow or nutrition by prolonged pressure of a part of the body exposed to a bed. Sometimes, one or more bedsores occurring on a limb of an individual can lead to amputation of the affected limb. Also, the Achilles tendons can shorten, loose elasticity, and atrophy from nonuse as a result of long term confinement to a bed. Once the Achilles tendons shorten, it can be very difficult to walk, and can lead to the tearing of the affected Achilles tendon from activity subsequent to prolonged confinement to a bed. The shortening of the Achilles tendon may be remedied with extensive physical therapy to lengthen and strengthen the affected Achilles tendon, and in extreme cases, surgical correction, both of which are normally very expensive.

Although there exist apparatus that aid individuals from sustaining bedsores, such as adjustable beds and other auxiliary devices usable in combination with a bed, there are presently no devices usable in combination with a bed for inhibiting not only bedsores and other physiologically adverse effects associated with prolonged confinement to a bed, but also the shortening the Achilles tendons resulting from prolonged confinement to a bed.

It would be highly advantageous, therefore, to remedy the foregoing and other deficiencies inherent in the prior art.

Accordingly, it is an object of the present invention to provide a support apparatus usable in combination with a bed for inhibiting physiologically adverse effects resulting from such prolonged confinement to a bed.

It is a further object of the present invention to provide a support apparatus usable in combination with a bed for inhibiting the shortening of the Achilles tendons in individuals or patients confined to a bed for prolonged periods of time.

Another object of the present invention is to provide a support apparatus that is easy to use.

And another object of the present invention is to provide a support apparatus that is easy to manufacture.

Still another object of the present invention is to provide a support apparatus that is inexpensive to manufacture.

Yet another object of the instant invention is to provide a support apparatus that is easy to install.

Yet still another object of the instant invention is to provide a support apparatus that may be used in combination with an adjustable bed.

And a further object of the invention is to provide a support apparatus that may be easily detached or removed when use is no longer required.

Still a further object of the immediate invention is to provide a support apparatus that adjusts with the movement of an adjustable bed.

Yet a further object of the invention is to provide a support apparatus that can aid an individual in positioning himself or herself while confined in a bed.

And yet still a further object of the instant invention is to provide a support apparatus that may be used as a therapeutic device for maintaining the strength and flexibility in the Achilles tendons of individuals or patients confined to a bed for a prolonged period of time.

SUMMARY OF THE INVENTION

Briefly, to achieve the desired objects of the instant invention in accordance with a preferred embodiment thereof, provided is a bed having a support apparatus for supporting the feet of a patient residing in a bed having a frame and a mattress carried thereon. The support apparatus includes a padded foot support member having a foot support surface. The padded foot support member is selectively coupled to portions of the bed above the mattress proximate the feet of an individual or patient residing in the bed, the support apparatus operative for allowing the patient to bear his or her feet against the padded foot support member to aid the patient in repositioning his or her body, for allowing the patient to exercise his or her feet for inhibiting the shortening of the Achilles tendons resulting from prolonged confinement to the bed, and for further inhibiting other physiologically adverse effects as a result of such prolonged confinement.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENT

Figures 1, 2, 3, 4, 5, 6, 7, 8:
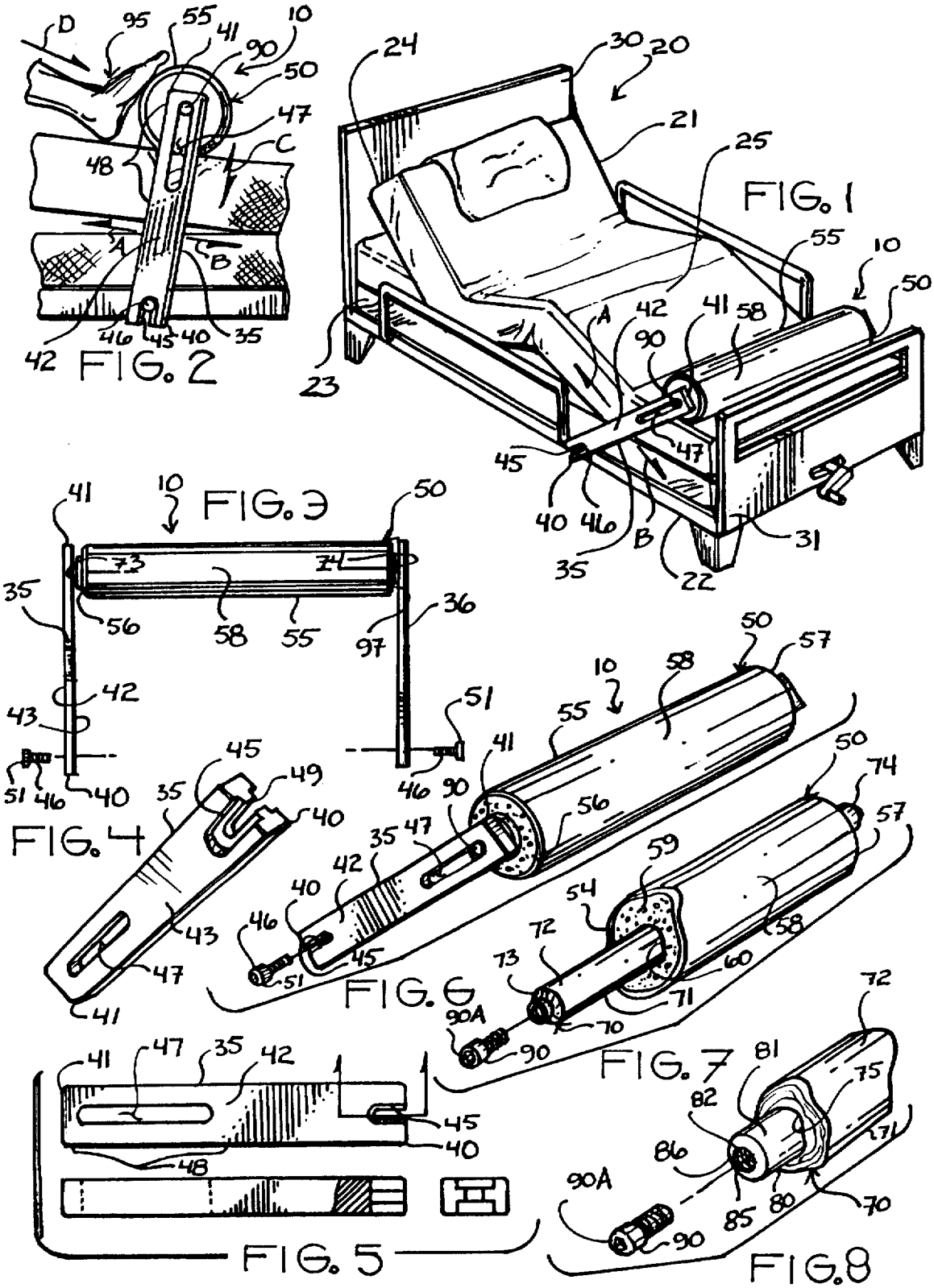
FIG. 1 is a perspective view of an embodiment of the instant invention constructed in accordance with the preferred embodiment, and further illustrated as it would appear in combination with an adjustable bed.
FIG. 2 is a side elevational view of the instant invention as it would appear in use.
FIG. 3 is a front elevational view of the instant invention.
FIG. 4 is an enlarged perspective view of an elongate bracket element of the instant invention.
FIG. 5 is a top elevational view and side elevational view of the elongate bracket element depicted in FIG. 4.
FIG. 6 is an enlarged perspective view of the instant invention first depicted in FIG. 1.
FIG. 7 is an enlarged perspective view of portions of the instant invention similar to the view of FIG. 6, with portions thereon broken away for the purpose of illustration.
FIG. 8 is an enlarged fragmentary perspective view of portions of the instant invention similar to the view of FIG. 7.

Turning now to the drawings, in which like reference characters indicate corresponding elements throughout the several views, attention is first directed to FIG. 1 which illustrates a first embodiment of the instant invention comprising a support apparatus being generally designated by the reference character 10. Support apparatus 10 functions as a body positioning mechanism and further as a therapeutic instrument, details of which will be herein described as the detailed description ensues.

As can be seen in FIG. 1, support apparatus 10, although potentially usable with other types of furniture such as day beds or other apparatus, is preferably suited for cooperation and use with a bed being generally designated by the reference character 20. Although any type of conventional bed may be used in combination with the instant invention, bed 20 is shown as an adjustable bed 21 having a generally rectangular frame 22 for supporting a box springs 23 having a mattress 24 carried thereon having an upper surface 25, the mattress being shown in a raised or adjusted configuration merely for the purpose of illustration. For the purpose of orientation, frame 22 includes a headboard 30 which defines the top or head of adjustable bed 21, and a footboard 31 which defines the bottom or foot of adjustable bed 21. Adjustable bed 21 is typical and well known by those having ordinary skill. Thus, further details of adjustable bed 21 will not be herein specifically described as they will be readily apparent and understood by those having ordinary skill. As can be seen from the above referenced drawing, support apparatus 10 is positioned proximate the foot of adjustable bed 21 for preferred use, details of which will follow shortly.

With continuing reference to FIG. 1, and additional reference to FIG. 2, FIG. 3, FIG. 4, and FIG. 5, support apparatus 10 includes a first elongate bracket element 35 and a second elongate bracket element 36. Preferably constructed of a substantially rigid and damage resistant material such as steel, aluminum, a type of plastic, or some other material having similar characteristics, first elongate bracket element 35 includes a lower end 40 which is bifurcated to form an open-ended slot 45 for receiving pin 46, an upper end 41, an outer surface 42, and an inner surface 43. First elongate bracket element 35 further includes a longitudinally extending slot 47 formed through a terminal upper portion 48 thereof. As can be seen best in FIG. 4, residing within open-ended slot 45 is seen an integrally molded inwardly extending generally U-shaped flange 49. Generally U-shaped flange 49 is operative for receiving portions of headed end 51 of pin 46, for retaining support apparatus 10 to portions of adjustable bed 21, details of which will be described shortly.

Second elongate bracket element 36 is identical to first bracket element 35. Accordingly, the detailed physical attributes of second elongate bracket element 36 will not be herein specifically described as they have been sufficiently described and disclosed in combination with first elongate bracket element 35. With respect to the preferred embodiment, first elongate bracket element 35 and second elongate bracket element 36 of support apparatus 10 are spaced apart and define substantially parallel planes.

With continuing reference to FIG. 1, FIG. 2, and FIG. 3, and additional reference to FIG. 6, coupled to, residing between, and interconnecting first elongate bracket element 35 and second elongate bracket element 36 in a generally horizontal configuration is seen a foot support member 50. Consistent with the nature of the instant invention as herein disclosed, it is desirable for foot support member 50 to be selectively positioned proximate the feet of an individual residing in adjustable bed 21, or other such bed as selectively desired. Therefore, with respect to the preferred embodiment, open-ended slot 45 proximate lower end 40 of first elongate bracket element 35, and similarly with respect to second elongate bracket element 36, receive pin 46 which is then coupled, preferably threadably coupled, to portions of frame 22 proximate the foot of adjustable bed 21. When pin 46 is introduced through portions of each respective open-ended slot, and threadably coupled to frame 22, portions of headed end 51 of pin 46 bear against portions of generally U-shaped flange for retaining first elongate bracket element 35 and second elongate bracket element in place proximate frame 22. When support apparatus 10 is installed, first and second elongate bracket elements, 35 and 36, extend in a generally upwardly and forwardly configuration such that foot support member 50 rests above mattress 24 proximate the foot of adjustable bed 21. First and second elongate bracket elements, 35 and 36, are preferably installed in pivotal relation about pin 46 so that as mattress 24 is selectively adjusted between a raised and lowered position, the adjustable characteristics of adjustable bed 21 of which will be readily appreciated by those having ordinary skill, first and second elongate bracket elements, 35 and 36, are allowed to pivot in the direction indicated by arrowed line A towards the top of adjustable bed 21 and in the direction indicated by arrowed line B towards the foot of adjustable bed 21 as necessary with the movement of mattress 24 as upper surface 25 of mattress 24 bears against foot support member 50. The first elongate bracket element 35 and the second elongate bracket element 36 function as a coupling means for coupling and detachably coupling foot support member 50 to frame 22. It will be readily appreciated that other suitable coupling means such as clamps or other coupling means may be used in combination with the instant invention for securing or coupling foot support member 50 to adjustable bed 21 as selectively desired without departing from the nature and scope of the instant invention as herein disclosed.

With respect to the preferred embodiment, foot support member 50, details of which can further be seen in combination with FIG. 7 and FIG. 8, includes a generally cylindrical elongate element 55 having a first free end 56 and a second free end 57. Generally cylindrical elongate element 55 further includes a generally cylindrical outer layer 54 having a generally cylindrical outer surface 58 and a generally cylindrical inner surface (not herein specifically shown) substantially surrounding an inner layer 59 having a predetermined thickness and extending inwardly and terminating with and defining longitudinal bore 60. With respect to the preferred embodiment, generally cylindrical outer layer 54 is preferably constructed of a substantially pliant material such as vinyl, a type of cloth, or other suitably pliant and substantially resilient material. Furthermore, inner layer 59 is also preferably constructed of a substantially pliant substance such as batting, foam, or other similarly pliant substance. Additionally, generally cylindrical outer layer 54 and inner layer 59 function as a padding layer, thereby functioning to define foot support member 50 as a padded foot support member.

Extending through longitudinal bore 60 exists an elongate support member 70, and being substantially surrounded by the padding layer. Although elongate support element 70 may be constructed from a single piece of selected material, or of any preferred configuration or dimension, elongate support member 70 is preferably comprised of a substantially rigid generally cylindrical outer elongate support element 71 having a generally cylindrical outer surface 72, a first end 73 extending beyond first free end 56, a second end 74 extending beyond second free end 57, and a longitudinal bore 75 extending therethrough. Elongate support element 70 further includes a substantially rigid generally cylindrical inner elongate support element 80 having a generally cylindrical outer surface 81, a first support end 82 extending beyond first end 73, a second support end (not herein specifically shown) extending beyond second end 74, and a longitudinal bore 85 extending therethrough having a threaded portion 86 proximate first support end 82 and second support end (not herein specifically shown). Outer elongate support element 71 may be constructed of any suitable and substantially rigid material such as hard plastic, hard foam, wood, or another substantially rigid and suitable substance. Furthermore, inner elongate support element 80 may suitably be constructed of steel, aluminum, or other substances having similar characteristics. Elongate support element 70 functions as a support means for providing structural integrity and strength to foot support member 50.

Foot support member 50 is preferably rotatably and slidably coupled to first elongate bracket element 35 and second elongate bracket element by means of a pin 90, one of which is each slidably and rotatably received and retained by longitudinally extending slot 47 formed in first elongate bracket element 35 and second elongate bracket element 36, and preferably threadably received by threaded portion 86 proximate first support end 82 and second support end (not herein specifically shown) of inner elongate support element 80. When installed, threaded portion 91 of each pin 90 passes through each longitudinally extending slot 47, with each threaded portion 91 being threadably received by threaded portion 86, such that headed end 90A of each pin 90 becomes slidably and rotatably retained within each longitudinally extending slot 47 As a result of such a configuration, foot support member 50 is permitted to slide up and down in the directions indicated by double arrowed line C in FIG. 2 and rotate along the full length of each longitudinally extending slot 47 during use thereof, and as results from the selective adjustment of adjustable bed 21 as support apparatus 10 pivots with the movement of adjustable bed 21. Although it is preferred that foot support member 50 is rotatably and slidably coupled to first and second elongate bracket elements, 35 and 36, it will be appreciated by those having ordinary skill that foot support may be rigidly mounted as selectively desired without departing from the nature and scope of the instant invention as herein specifically described. Furthermore, although foot support member 50 has been herein disclosed as being generally cylindrical in shape, other shapes may suitably be used in lieu thereof as selectively desired.

With reference back to FIG. 1 and FIG. 2, when support apparatus 10 is installed, generally cylindrical outer surface 58 bears against and rests against upper surface 25. When an individual or patient occupies adjustable bed 21, the feet of the individual or patient normally rest proximate foot of adjustable bed 21. The foot support member 50 is preferably installed proximate the feet of an individual residing in adjustable bed 21. As such, when adjustable bed 21 is adjusted, the patient or individual may bear their feet, the feet being generally designated by the reference character 95 in FIG. 2, and push against generally cylindrical outer surface 58 of foot support member 50 in the direction indicated by arrowed line D to position himself or herself in adjustable bed 21 as it adjusts, the generally cylindrical outer surface 58 functioning as a foot support surface or a bearing surface. Additionally, for individuals or patients confined to a bed for a prolonged period of time, support apparatus 10 may be used a therapeutic device to inhibit physiologically adverse effects resulting from such prolonged confinement. In particular, to prevent or inhibit the shortening of the Achilles tendon as a result of prolonged confinement to a bed, the patient or individual may bear his or her feet against the foot support surface of support apparatus 10 to stretch and exercise his or her feet and Achilles tendons to inhibit the shortening of the Achilles tendons.

Foot support 10 may be coupled anywhere along the length of frame 22 as selectively desired so that when an individual occupies adjustable bed 21, foot support 10 resides proximate the feet of the individual residing thereon. Furthermore, instead of being pivotally mounted, foot support 10 may be rigidly coupled to adjustable bed 21 if selectively desired, without departing from the nature and scope of the instant invention as herein specifically described.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A support apparatus for supporting the feet of an individual residing in a bed, said bed including a mattress having an upper surface for receiving said individual thereon and supported by a frame, said support apparatus comprising:

a generally cylindrical foot support member selectively positionable proximate the feet of said individual, said foot support member including a substantially pliant padding layer having a bearing surface for receiving the feet of said individual so that said individual may reposition himself or herself while residing upon said mattress of said bed, and for exercising said feet thereagainst said bearing surface for inhibiting physiologically adverse effects to said individual resulting from said individual's prolonged confinement to said bed;

support means, cooperative with said padding layer for providing structural integrity and strength to said foot support member;

a substantially rigid first elongate bracket element having a lower end coupled to portions of said frame, and an upper end coupled to portions of said support means; and a substantially rigid second elongate bracket element spaced apart from said first elongate bracket element, said second elongate bracket element having a lower end coupled to portions of said frame, and an upper end coupled to portions of said support means.

2. The support apparatus of claim 1, wherein said foot support member is rotatably coupled to said first elongate bracket element and said second elongate bracket element.

3. The support apparatus of claim 1, wherein said foot support member is rotatably and slidably coupled to said first elongate bracket element and said second elongate bracket element.

4. The support apparatus of claim 1, wherein said foot support member is substantially pliant.

5. The support apparatus of claim 1, wherein said padding layer includes:

an inner layer having a predetermined thickness; and an outer layer substantially surrounding said inner layer and having said bearing surface.

6. A support apparatus for supporting the feet of an individual residing in a bed, said bed including a mattress having an upper surface for receiving said individual thereon and supported by a frame, said support apparatus comprising:

a foot support member selectively positionable proximate the feet of said individual, said foot support member including a substantially pliant padding layer having a bearing surface for receiving the feet of said individual so that said individual may reposition himself or herself while residing upon said mattress of said bed, and for exercising said feet thereagainst said bearing surface for inhibiting physiologically adverse effects to said individual resulting from said individual's prolonged confinement to said bed;

support means, cooperative with said padding layer for providing structural integrity and strength to said foot support member, said support means includes a substantially rigid elongate support element including:

an outer elongate support element having a first end extending beyond a first free end of said padding layer and a second end extending beyond a second free end of said padding layer; and an inner elongate support element being substantially surrounded by said outer elongate support element, said inner elongate support element having a first support end extending beyond said first end of said outer elongate support element, and a second support end extending beyond said second end of said outer elongate support element;

a substantially rigid first elongate bracket element having a lower end coupled to portions of said frame, and an upper end coupled to portions of said support means; and a substantially rigid second elongate bracket element spaced apart from said first elongate bracket element, said second elongate bracket element having a lower end coupled to portions of said frame, and an upper end coupled to portions of said support means, wherein said first support end and said second support end are rotatably and slidably coupled to said first elongate bracket element and said second elongate bracket element, respectively.

7. A bed for inhibiting physiologically adverse effects of prolonged confinement to said bed by an individual, said bed comprising:

a mattress having an upper surface for receiving said individual thereon;

a frame for supporting said mattress;

a support apparatus, cooperative with said bed, and including a generally cylindrical foot support member having a substantially pliant padding layer with a bearing surface selectively positionable proximate the feet of said individual for receiving the feet of said individual so that said individual may reposition himself or herself while residing upon said upper surface of said mattress of said bed, and for exercising said feet thereagainst said bearing surface for inhibiting physiologically adverse effects to said individual resulting from said individual's prolonged confinement to said bed; support means, cooperative with said padding layer for providing structural integrity and strength to said foot support member;

a substantially rigid first elongate bracket element having a lower end coupled to portions of said frame, and an upper end coupled to portions of said support means; and a substantially rigid second elongate bracket element spaced apart from said first elongate bracket element, said second elongate bracket element having a lower end coupled to portions of said frame, and an upper end coupled to portions of said support means.

8. The support apparatus of claim 7 wherein said foot support member is rotatably coupled to said first elongate bracket element and said second elongate bracket element.

9. The support apparatus of claim 7, wherein said foot support member is rotatably and slidably coupled to said first elongate bracket element and said second elongate bracket element.

10. The support apparatus of claim 7, wherein said padding layer includes:

an inner layer having a predetermined thickness; and an outer layer substantially surrounding said inner layer and having said bearing surface.

11. A bed for inhibiting physiologically adverse effects of prolonged confinement to said bed by an individual, said bed comprising:

a mattress having an upper surface for receiving said individual thereon;

a frame for supporting said mattress;

a support apparatus, cooperative with said bed, and including a foot support member having a substantially pliant padding layer with a bearing surface selectively positionable proximate the feet of said individual for receiving the feet of said so that said individual may reposition himself or herself while residing upon said upper surface of said mattress of said bed, and for exercising said feet thereagainst said bearing surface for inhibiting physiologically adverse effects to said individual resulting from said individual's prolonged confinement to said bed;

support means, cooperative with said padding layer for providing structural integrity and strength to said foot support member, said support means includes a substantially rigid elongate support element including:

an outer elongate support element having a first end extending beyond a first free end of said padding layer and a second end extending beyond a second free end of said padding layer; and an inner elongate support element being substantially surrounded by said outer elongate support element, said inner elongate support element having a first support end extending beyond said first end of said outer elongate support element, and a second support end extending beyond said second end of said outer elongate support element;

a substantially rigid first elongate bracket element having a lower end coupled to portions of said frame, and an upper end coupled to portions of said support means; and a substantially rigid second elongate bracket element spaced apart from said first elongate bracket element, said second elongate bracket element having a lower end coupled to portions of said frame, and an upper end coupled to portions of said support means, wherein said first support end and second support end are rotatably and slidably coupled to said first elongate bracket element and said second elongate bracket element, respectively.

12. A support apparatus for supporting the feet of an individual residing in a bed, said bed including a mattress having an upper surface for receiving said individual thereon and supported by a frame, said support apparatus comprising:

a foot support member selectively positionable proximate the feet of said individual, said foot support member including a substantially pliant padding layer having a bearing surface for receiving the feet of said individual so that said individual may reposition himself or herself while residing upon said mattress of said bed, and for exercising said feet thereagainst said bearing surface for inhibiting physiologically adverse effects to said individual resulting from said individual's prolonged confinement to said bed;

coupling means for coupling said foot support member proximate said bed; and a substantially rigid elongate support element including an outer elongate support element having a first end extending beyond a first free end of said padding layer and a second end extending beyond a second free end of said padding layer, and an inner elongate support element being substantially surrounded by said outer elongate support element, said inner elongate support element having a first support end extending beyond said first end of said outer elongate support element, and a second support end extending beyond said second end of said outer elongate support element, said first support end and said second support end movably coupled to said coupling means.

13. The support apparatus of claim 12, wherein said first support end and said second support end of said inner elongate support element are each rotatably coupled to said coupling means.

14. The support apparatus of claim 12 wherein said first support end and said second support end of said inner elongate support element are each rotatably and slidably coupled to said coupling means.

15. The support apparatus of claim 12, wherein said foot support member is generally cylindrical.

16. The support apparatus of claim 12, wherein said padding layer includes:

an inner layer having a predetermined thickness; and an outer layer substantially surrounding said inner layer and having said bearing surface.

17. The support apparatus of claim 12, wherein said coupling means includes:

a first elongate bracket element having a lower end coupled to portions of said frame, and an upper end coupled to portions of said foot support member; and a second elongate bracket element spaced apart from said first elongate bracket element, said second elongate bracket element having a lower end coupled to portions of said frame, and an upper end coupled to portions of said foot support member.

18. A bed for inhibiting physiologically adverse effects of prolonged confinement to said bed by an individual, said bed comprising:

a mattress having an upper surface for receiving said individual thereon;

a frame for supporting said mattress;

a support apparatus, cooperative with said bed, and including a foot support member having a bearing surface selectively positionable proximate the feet of said individual for receiving the feet of said individual for receiving the feet of said individual so that said individual may reposition himself or herself while residing upon said upper surface of said mattress of said bed, and for exercising said feet thereagainst said bearing surface for inhibiting physiologically adverse effects to said individual resulting from said individual's prolonged confinement to said bed;

coupling means for coupling said foot support member proximate said frame; and a substantially rigid elongate support element including an outer elongate support element having a first end extending beyond a first free end of said padding layer and a second end extending beyond a second free end of said padding layer, and an inner elongate support element being substantially surrounded by said outer elongate support element, said inner elongate support element having a first support end extending beyond said first end of said outer elongate support element and a second support end extending beyond said second end of said outer elongate support element, said first support end and said second support end movably coupled to said coupling means.

19. The bed of claim 18, wherein said first support end and said second support end of said inner elongate support element are each rotatably coupled to said coupling means.

20. The bed of claim 18, wherein said first support end and said second support end of said inner elongate support element are each rotatably and slidably coupled to said coupling means.

21. The bed of claim 18, wherein said foot support member is generally cylindrical.

22. The bed of claim 18, wherein said padding layer includes:

an inner layer having a predetermined thickness; and an outer layer substantially surrounding said inner layer and having said bearing surface.

23. The support apparatus of claim 18, wherein said coupling means includes:

a first elongate bracket element having a lower end coupled to portions of said frame, and an upper end coupled to portions of said foot support member; and a second elongate bracket element spaced apart from said first elongate bracket element, said second elongate bracket element having a lower end coupled to portions of said frame, and an upper end coupled to portions of said foot support member.

* * * * *